US007710225B2

(12) United States Patent
Uni

(10) Patent No.: US 7,710,225 B2
(45) Date of Patent: May 4, 2010

(54) ACTUATOR

(75) Inventor: Masahiko Uni, Ueda (JP)

(73) Assignee: Shinano Kenshi Kabushiki Kaisha, Nagano (JP)

( * ) Notice: Subject to any disclaimer, the term of this patent is extended or adjusted under 35 U.S.C. 154(b) by 68 days.

(21) Appl. No.: 11/667,320

(22) PCT Filed: Nov. 10, 2005

(86) PCT No.: PCT/JP2005/020582

§ 371 (c)(1),
(2), (4) Date: May 8, 2007

(87) PCT Pub. No.: WO2006/051838

PCT Pub. Date: May 18, 2006

(65) Prior Publication Data

US 2007/0285196 A1 Dec. 13, 2007

(30) Foreign Application Priority Data

Nov. 11, 2004 (JP) ..... 2004-327236

(51) Int. Cl.
*H01F 7/08* (2006.01)

(52) U.S. Cl. ..... 335/220; 335/232; 335/234; 335/238; 335/249; 335/261; 335/103; 335/183; 335/212; 335/230; 335/262; 335/270; 335/274; 335/279; 335/280; 335/281; 335/282; 335/295; 335/297

(58) Field of Classification Search ..... 335/103, 335/183, 212, 220, 230, 232, 234, 238, 249, 335/261, 262, 270, 274, 279–282, 295, 297
See application file for complete search history.

(56) References Cited

U.S. PATENT DOCUMENTS

| | | | | | |
|---|---|---|---|---|---|
| 1,817,592 | A | * | 8/1931 | Sokoloff | 335/259 |
| 2,407,963 | A | * | 9/1946 | Persons | 335/261 |
| 3,510,814 | A | * | 5/1970 | Nordfors | 335/262 |
| 4,233,585 | A | * | 11/1980 | Sugimoto et al. | 335/262 |
| 4,429,342 | A | | 1/1984 | Heider et al. | |
| 4,539,542 | A | | 9/1985 | Clark | |
| 4,554,610 | A | * | 11/1985 | Metz et al. | 361/144 |
| 4,604,600 | A | | 8/1986 | Clark | |
| 5,402,093 | A | * | 3/1995 | Gibas et al. | 335/261 |

(Continued)

FOREIGN PATENT DOCUMENTS

JP 57-183003 A 11/1982

(Continued)

*Primary Examiner*—Elvin G Enad
*Assistant Examiner*—Mohamad A Musleh
(74) *Attorney, Agent, or Firm*—Birch, Stewart, Kolasch & Birch, LLP

(57) ABSTRACT

The present invention provides the actuator, which is capable of preventing biased abrasion by lowering a surface pressure at a contact portion of a movable element with a guide surface and increasing a movable range, in which a specified output force can be gained. Magnetic resistance of at least one of the surfaces (Y1, Y2) of first and second yoke parts (5, 6) corresponding to peripheral surfaces (P1, P2) of a plunger (7), on which magnetic flux acting surfaces are formed by energization, is unbalanced in the circumferential direction so as to act a resultant force of magnetic forces acting on the movable element in the radial direction eccentrically to a radial one end (E1) side.

3 Claims, 8 Drawing Sheets

U.S. PATENT DOCUMENTS

| | | | | |
|---|---|---|---|---|
| 6,206,343 | B1 * | 3/2001 | Kato et al. | 251/129.15 |
| 6,377,146 | B1 * | 4/2002 | Batteux | 335/280 |
| 6,737,946 | B2 * | 5/2004 | Seale et al. | 335/279 |
| 7,276,823 | B2 * | 10/2007 | Ichikawa et al. | 310/23 |
| 2001/0022474 | A1 | 9/2001 | Tachibana et al. | |
| 2004/0100345 | A1 * | 5/2004 | Kobayashi | 335/220 |
| 2006/0097437 | A1 * | 5/2006 | Watanabe | 267/140.14 |

FOREIGN PATENT DOCUMENTS

| | | | |
|---|---|---|---|
| JP | 1-287108 | A | 12/1986 |
| JP | 11-162732 | A | 6/1999 |
| JP | 11-162733 | A | 6/1999 |
| JP | 2000-164424 | A | 6/2000 |
| JP | 2001-263521 | A | 9/2001 |
| JP | 2004-153063 | A | 5/2004 |

* cited by examiner

ACTUATOR

BACKGROUND OF THE INVENTION

The present invention relates to an actuator, e.g., linear solenoid.

BACKGROUND TECHNOLOGY

Various types of actuators have been used for automatically controlling conventional industrial machines. For example, a linear solenoid is used as an electromagnetic component for converting electromagnetic energy into mechanical energy. A generic solenoid has a stator including an exciting coil and a movable iron core (plunger), which is provided to a center part of the stator and capable of moving to and away from a stator core. By energizing the exciting coil of the stator, a magnetic circuit is formed between a first and second yoke parts and the plunger, so that an attraction force acts on the plunger.

In case of the generic solenoid in which magnetic flux acting surfaces are formed in axial end faces of the plunger, an output force (thrust force) is apt to be exponentially reduced with respect to a stroke, which is a relative moving distance of the movable element with respect to the yoke (see FIG. 16). To improve the thrust force reduction of the movable element, magnetic flux acting surfaces are formed, in the radial direction, between peripheral surfaces of the movable element and the yoke parts corresponding to the peripheral surfaces (see Patent Document 1).

A generic structure of a conventional linear solenoid will be explained with reference to FIGS. 13 and 14. Firstly, a stator 51 includes an exciting coil 53, which is wound on a bobbin 52, and first and second yoke parts 54 and 55, which cover the exciting coil 53. The first yoke part 54 is formed like a lid and covers the axial one end side of the exciting coil 53. The second yoke part 55 is formed into a cup shape and covers a body part of the exciting coil 53 from the other end side thereof. The first and second yoke parts 54 and 55 form a magnetic circuit on the stator 51 side when the exciting coil 53 is energized. A pipe (guide pipe) 56 made of a nonmagnetic material is fitted in an axial hole of the bobbin 52. A movable element (plunger) 57 is slidably fitted in an axial hole of the guide pipe 56. A connecting rod (not shown) is connected in an axial hole 58 of the plunger 57 so as to transmit a driving force for moving the plunger 57 in the axial direction. In the linear solenoid shown in FIG. 14, a circular groove or a stepped surface (a groove 59 is employed in the shown example) is formed in a peripheral surface of at least one end side of the plunger 57, so that a magnetic flux acting surface is formed in the radial direction. Namely, the magnetic flux acting surfaces are respectively formed between the peripheral surfaces P1 and P2 of the plunger 57 and the corresponding surfaces Y1 and Y2 of the first and second yokes 54 and 55; magnetic resistance between the corresponding surfaces are low, so that a great output force (thrust force) can be gained in a controllable range.

Patent Document 1: Japanese Patent Kokai Gazette No. 2004-153063

DISCLOSURE OF THE INVENTION

However, in the linear solenoid shown in FIG. 14, great attraction forces entire-circumferentially act between the peripheral surfaces P1 and P2 of the plunger 57 and the surfaces Y1 and Y2 of the first and second yoke parts 54 and 55. A clearance within a tolerance is formed between an outer diameter of the plunger 57 and an inner diameter of the guide pipe 56, so the plunger 57, which is in a slightly tilted posture, will move in the guide pipe 56 as shown in FIG. 15. In this case, the plunger 57 point-contacts the guide pipe 56 at diagonal portions (corners) in an axial sectional plane of the plunger 57 and slides in that posture, so that biased abrasion of a film surface of the plunger is accelerated (see sliding parts Q and R shown in FIG. 15) and a life span of the plunger will be short.

According to the positional relationships between the plunger 57 and the first and second yoke parts 54 and 55, magnetic resistance is apt to be drastically varied, and the thrust force will be sharply increased when the exciting coil 53 is energized; therefore, a stroke controllable range, in which the stroke can be controlled with a constant thrust force, is limited, and controllability must be low.

The present invention has been invented to solve the above described problems, and an object of the present invention is to provide an actuator, which is capable of preventing biased abrasion by lowering a surface pressure at a contact portion of a movable element with a guide surface and increasing a movable range, in which a specified output force can be gained.

To achieve the object, the present invention has the following structures.

The actuator comprises: an exciting coil; a stator having a first yoke part, which is formed on the one end side of the exciting coil, and a second yoke part, which is formed on the other side of the exciting coil, so as to cover the exciting coil; and a movable element being provided in a center part of the exciting coil and capable of reciprocally moving in the axial direction, a magnetic circuit is formed between the first and second yoke parts and the movable element by energization, a magnetic force acts on a movable element, and the actuator is characterized in that magnetic resistance of at least one of the surfaces of the first and second yoke parts corresponding to peripheral surfaces of the movable element, on which magnetic flux acting surfaces are formed by energization, is unbalanced in the circumferential direction so as to act a resultant force of magnetic forces acting on the movable element in the radial direction eccentrically to a radial one end side.

For example, a facing area of at least one of the surfaces of the first and second yoke parts corresponding to the peripheral surfaces of the movable element is gradually reduced from the radial one end side of the movable element to the other end side thereof.

Further, a sloped groove or a step-shaped notch is formed in the peripheral surface of the movable element, on which the magnetic flux acting surface is formed, so as to gradually reduce a facing area of the movable element corresponding to at least one of the opposed surfaces of the first and second yoke parts from the radial one end side of the movable element to the other end side thereof.

Further, a sloped groove or a step-shaped notch is formed in at least one of the first and second yoke parts, on which the magnetic flux acting surfaces are formed, so as to gradually reduce a facing area of the yoke part from the radial one end side of the movable element to the other end side thereof.

EFFECTS OF THE INVENTION

In the above described actuator, the magnetic resistance of at least one of the opposed surfaces of the first and second yoke parts corresponding to the peripheral surfaces of the movable element, on which the magnetic flux acting surfaces are formed by energization, is unbalanced in the circumferential direction so as to act the resultant force of the magnetic forces acting on the movable element in the radial direction eccentrically to the radial one end side. With this structure, magnetic flux passing through the movable element is biased to the radial one end side, where the magnetic resistance is lower, the magnetic force acting on the movable element is increased on the radial one end side immediately after energizing the exciting coil. Therefore, the movable element, which has been attracted to the radial one end side, slides on the guide face with maintaining that state, so that the biased abrasion of a film surface of the movable element can be restrained by lowering the surface pressure at the contact portion of the movable element with the guide surface and a life span of the movable element can be longer.

Further, the facing area of the peripheral surface of the movable element, on which the magnetic flux acting surfaces is formed by energization, and at least one of the opposed surfaces of the first and second yoke parts are gradually reduced from the radial one end side of the movable element to the other end side thereof; the attraction force between the movable element and the first and second yoke parts is made greater from the radial one end side, in which the magnetic resistance is lower, and the facing area is gradually broader with moving the movable element toward the stator and the attraction force is made greater, so that a movable range, in which a specified output force can be gained, can be increased. Therefore, variation of the movable range of the movable element, which is caused by differences of the thrust forces, can be restrained, and the movable range, in which the specified output force can be gained, can be increased, so that controllability within the actual movable range of the movable element can be improved.

PREFERRED EMBODIMENTS OF THE INVENTION

Preferred embodiments of the actuator of the present invention will now be described with reference to the accompanying drawings. In the following embodiments, linear solenoids will be explained as the actuators.

First Embodiment

Figure 1:
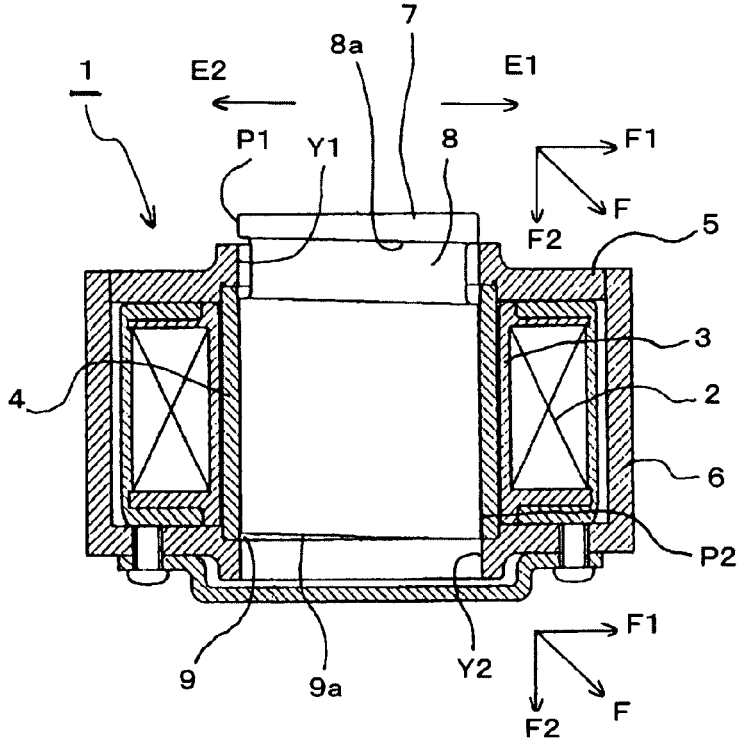
FIG. 1 is a sectional view of a linear solenoid of a first embodiment.

An outline of the linear solenoid will be explained with reference to FIG. 1.

Firstly, a stator 1 will be explained. An exciting coil 2 is wound on a bobbin 3. A pipe (guide pipe) 4 made of a nonmagnetic material is fitted in an axial hole of a core part of the bobbin 3. The exciting coil 2 is covered with a first yoke part 5, which is formed like a lid and provided on one end side, and a second yoke part 6, which is formed into a cup shape and covers form the other side. The first yoke part 5 and the second yoke part 6 are made of a magnetic material, and they form a magnetic flux path of the stator 1 when the exciting coil 2 is energized.

A movable element (plunger) 7 is guided by the guide pipe 4, which is provided to a center part of the exciting coil 2 (in the axial hole of the bobbin 3), and capable of reciprocally moving in the axial direction. Note that, the core part of the bobbin may be used for guiding the plunger 7 instead of the guide pipe 4. The plunger 7 is connected to a connecting rod (not shown). For example, in case of a pull type solenoid, the plunger 7 or the connecting rod may be biased to project from the stator 1 by, for example, a coil spring. By energizing the exciting coil 2, a magnetic circuit is formed between the first and second yoke parts 5 and 6 and the plunger 7, so that attraction forces act on the plunger 7.

In the solenoid of the present embodiment, a circular groove or a stepped surface is formed in a peripheral surface of at least one end side of the plunger 7 (a groove 8 is formed in the present embodiment), so that a magnetic flux acting surface is formed in the radial direction. Namely, the magnetic flux acting surfaces are formed between a peripheral surface P1 of the plunger 7 formed on the one end side and an opposed surface Y1 of the first yoke part 5 opposing thereto and between a peripheral surface P2 of the plunger 7 formed on the other side and an opposed surface Y2 of the second yoke part 6 opposing thereto. Facing areas of the peripheral surfaces of the plunger 7, on which the magnetic flux acting surfaces are formed by energization, or facing areas of the opposed surfaces of the first and second yoke part 5 and 6 (in the present embodiment, facing areas of the peripheral surfaces P1 and P2 of the plunger 7 and facing areas of the opposed surfaces Y1 and Y2 of the first and second yoke part 5 and 6) are gradually reduced from a radial one end E1 side of the plunger 7 to the other end E2 side thereof. Concretely, the inclined groove 8 (diagonally left up in FIG. 1) is formed in the peripheral surface P1 formed on the one end side of the plunger 7 so as to gradually reduce the facing area to the opposed surface Y1 of the first yoke part 5 from the radial one end E1 side to the other end E2 side. A step-shaped notch 9 is formed in the peripheral surface P2 formed on the other end side of the plunger 7 so as to gradually reduce the facing area to the opposed surface Y2 of the second yoke part 6 from the radial one end E1 side to the other end E2 side. Inclination of surfaces 8*a* and 9*a* constituting the groove 8 and the notch 9 may be same or different. The surfaces 8*a* and 9*a* may be not only flat surfaces but also curved surfaces, stepped surfaces, tapered surfaces, etc.

Figure 3:
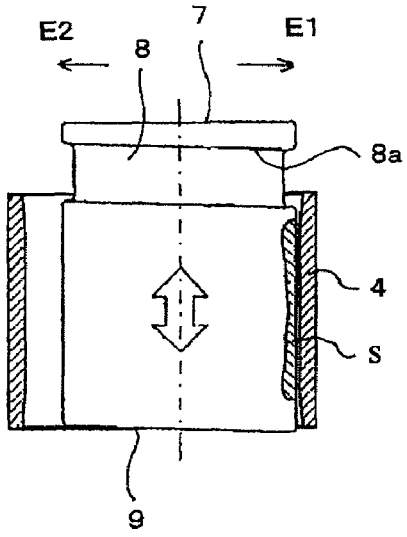
FIG. 3 is a partial enlarged view showing sliding parts of a plunger and a guide pipe relating to the present invention.

When the exciting coil 2 is energized, great attraction forces F (horizontal component forces F1 and vertical component forces F2) entire-circumferentially act between the peripheral surface (the magnetic flux acting surface) P1 on the one end side of the plunger 7 and the opposed surface (the magnetic flux acting surface) Y1 of the first yoke part 5 and between the peripheral surface (the magnetic flux acting surface) P2 on the other end side of the plunger 7 and the opposed surface (the magnetic flux acting surface) Y2 of the second yoke part 6. The plunger 7 is attracted in the radial direction by a resultant force of the horizontal component forces F1 of the forces F and attracted, in the axial direction, toward the stator 1 by the vertical component forces F2 thereof. Immediately after the energization, magnetic flux balance passing through the plunger 7 is biased to the radial one end E1 side, in which magnetic resistance is lower, so the resultant force of the horizontal component forces F1, which acts on the plunger 7, is increased on the radial one end E1 side. Therefore, as shown in FIG. 3, the plunger 7 in the guide pipe 4 is attracted toward the radial one end E1 side and slides with lowering a surface pressure at a contact portion with the guide pipe 4 (see the sliding part S shown in FIG. 3). With this structure, biased abrasion of a film surface of the plunger 7 can be restrained, so that a life span of the plunger can be extended.

Energy of the linear solenoid is stored in a gap between the stator 1 and the movable element (the plunger) 7. Unlike the solenoid whose magnetic flux acting surfaces are formed in the axial direction, the solenoid shown in FIG. 4, whose magnetic flux acting surfaces are formed in the radial direction, is capable of increasing the thrust force in an actual movable range. However, the magnetic resistance is apt to be sharply varied according to the position of the plunger, so the actual movable range, in which a specified thrust force can be gained, is apt to be small (see a curve A shown in FIG. 4). On the other hand, by forming the groove 8, which is formed in the peripheral surface P1 formed on the one end side of the plunger 7 so as to gradually reduce the facing area to the opposed surface Y1 of the first yoke part 5 from the radial one end E1 side to the other end E2 side, and the step-shaped notch 9, which is formed in the peripheral surface P2 formed on the other end side of the plunger 7 so as to gradually reduce the facing area to the opposed surface Y2 of the second yoke part 6 from the radial one end E1 side to the other end E2 side (see FIG. 1), the attraction forces F between the plunger 7 and the first and second yoke parts 5 and 6 are increased on the radial one end E1 side, in which the magnetic resistance is low, immediately after the energization. The magnetic resistance is gradually reduced toward the radial the other end E2 side and the attraction forces F are increased with moving the plunger 7 toward the stator 1, so that the specified thrust force can be gained within the long stroke (see a curve B shown in FIG. 4). Therefore, variation of the movable range of the plunger 7, which is caused by differences of the thrust forces, can be restrained, and the movable range of the plunger 7, in which the specified thrust force can be gained, can be increased, so that controllability within the actual movable range of the plunger 7 can be improved.

Second Embodiment

Next, another linear solenoid will be explained with reference to FIG. 2. The structure is similar to that shown in FIG. 1, so the same structural elements are assigned the same symbols and explanation will be omitted. The differences will be explained.

Figure 2:
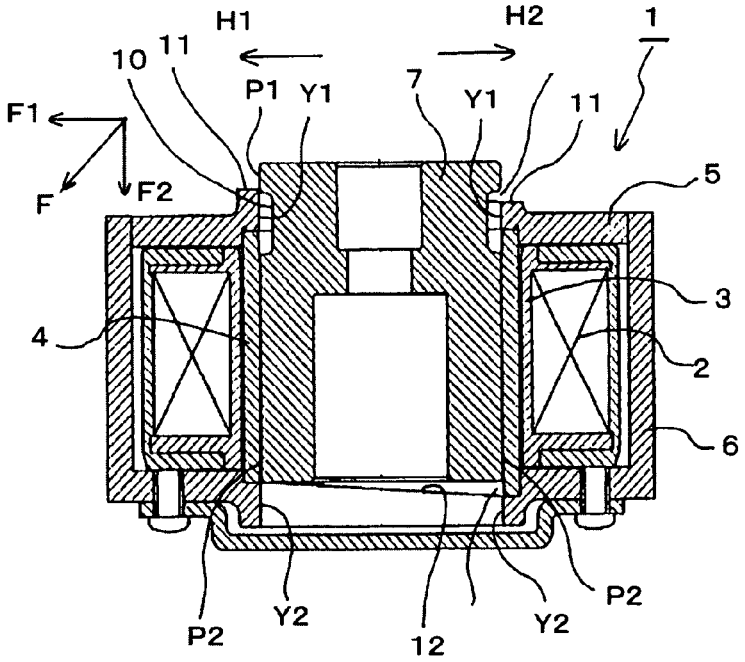
FIG. 2 is a sectional view of a linear solenoid of a second embodiment.

In FIG. 2, a circular groove, which has a fixed width and a fixed depth, or a stepped surface is formed in the peripheral surface P1 on the one end side of the plunger 7 (a groove 10 is formed in the present embodiment), and the magnetic flux acting surface is formed in the radial direction. The peripheral surface P2 on the other end side of the plunger 7 is a uniform circular face. A slope shape (or a stepped shape) is formed in the opposed surface Y1 of the first yoke part 5, which faces the peripheral surface P1 of the plunger 7, so as to gradually reduce a facing area of the opposed surface facing the peripheral surface P1 from a radial one end H1 side to the other end H2 side. Namely, in FIG. 2, the opposed surface Y1 of the first yoke part 5 includes a slope face (or a stepped face) 11 having an inclination (or steps) so as to gradually increase the magnetic resistance from the radial one end H1 side to the other end H2 side.

Further, a slope shape (or a stepped shape) is formed in the opposed surface Y2 of the second yoke part 6, which faces the peripheral surface P2 of the plunger 7, so as to gradually reduce a facing area of the opposed surface facing the peripheral surface P2 from the radial one end H1 side to the other end H2 side. Namely, the opposed surface Y2 of the first yoke part 6 includes a slope face (or a stepped face) 12 having an inclination (or steps) so as to gradually increase the magnetic resistance from the radial one end H1 side to the other end H2 side.

With the above described structure, the force F acting on the plunger 7 is increased on the radial one end H1 side, in which the magnetic resistance is lower, immediately after the energization, so the plunger 7 is attracted toward the radial one end H1 side and slides with lowering the surface pressure at the contact portion with the guide pipe 4 (see the sliding part S shown in FIG. 3). Therefore, biased abrasion of the film the surface of the plunger 7 can be restrained, so that a life span of the plunger can be extended.

Figure 4:
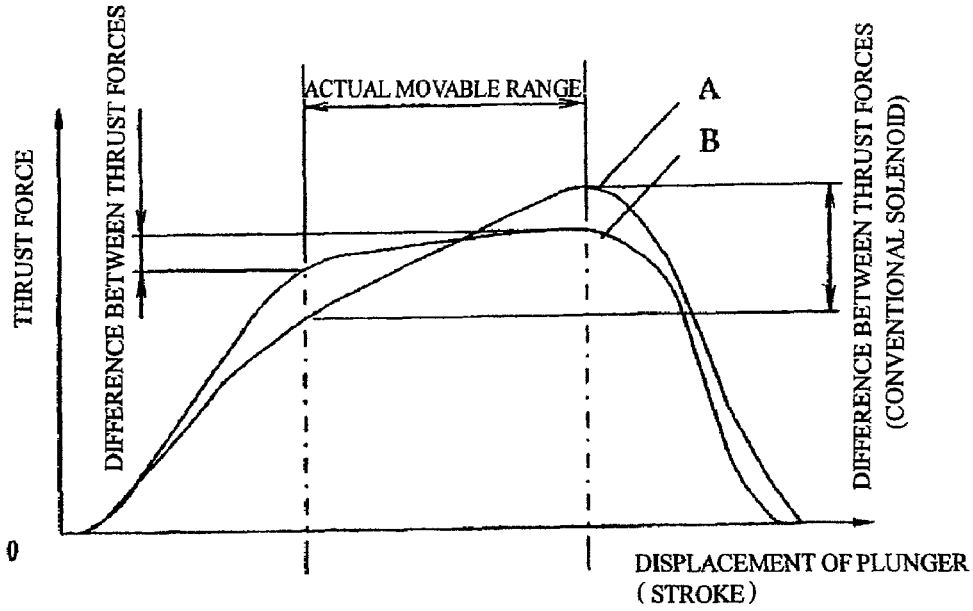
FIG. 4 is a graph showing a relationship between displacement of linear solenoids and thrust forces.

The attraction forces between the plunger 7 and the first and second yoke parts 5 and 6 are increased on the radial one end H1 side, in which the magnetic resistance is lower, immediately after the energization, the facing area is increased toward the other end H2 side, and the attraction forces F are increased with moving the plunger 7 toward the stator 1, so that the specified thrust force can be gained within the long stroke (see the curve B shown in FIG. 4). Therefore, variation of the movable range of the plunger 7, which is caused by differences of the thrust forces, can be restrained, and the movable range of the plunger 7, in which the specified thrust force can be gained, can be increased, so that controllability within the actual movable range of the plunger 7 can be improved.

Third Embodiment

Figure 5:
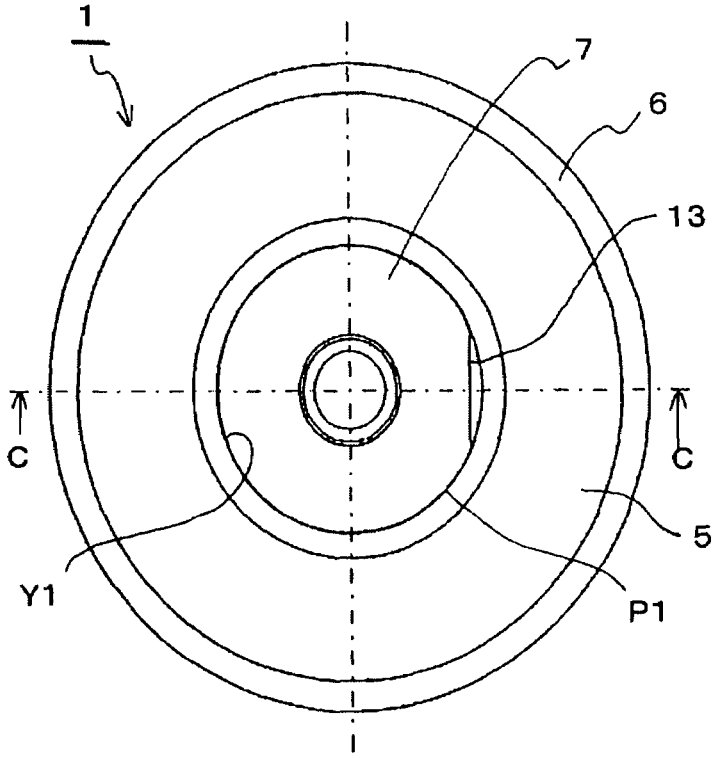
FIG. 5 is a plan view of a linear solenoid of a third embodiment.

Next, another linear solenoid will be explained with reference to FIGS. 5 and 6. The structure is similar to that of the first embodiment (see FIG. 1), so the same structural elements are assigned the same symbols and explanation will be omitted. The differences will be mainly explained.

Figure 6:
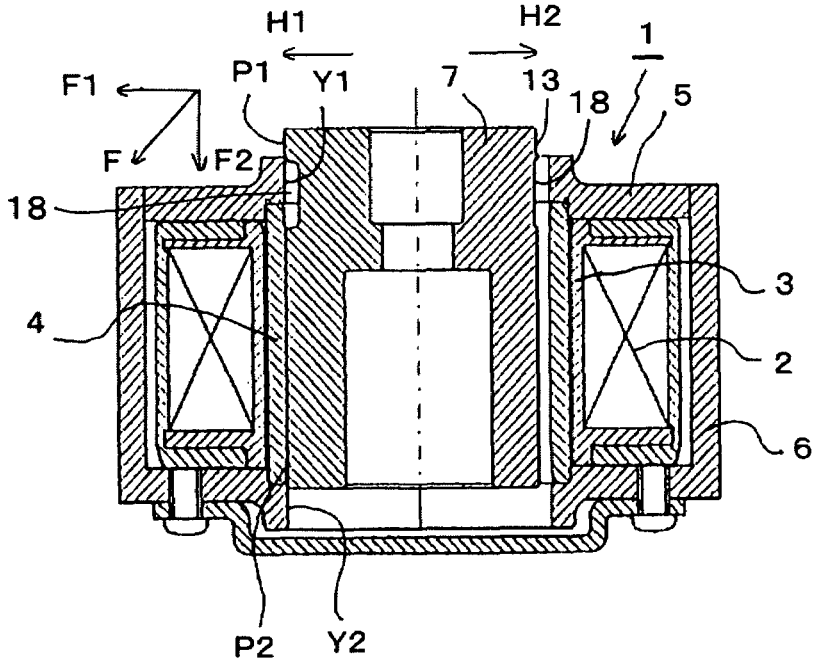
FIG. 6 is a sectional view of the linear solenoid taken along a line C-C shown in FIG. 5.

In FIG. 6, a circular groove or a stepped surface is formed in the peripheral surface of at least one of the end sides of the plunger 7 (a groove 18 is formed in the present embodiment), and the magnetic flux acting surface is formed in the radial direction. In the present embodiment, as shown in FIG. 5, a chamfered part (having a D-shaped section, e.g., D-cut face 13) is formed in the peripheral surface of the plunger 7, on which the magnetic flux acting surface is formed in the radial direction by energization. By forming the D-cut face 13, the magnetic resistance between the peripheral surface of the plunger and the opposed surfaces of the first and second yoke parts 5 and 6 are unbalanced in the circumferential direction.

In FIG. 6, when the exciting coil 2 is energized, the attraction forces F (the horizontal component forces F1 and the vertical component forces F2) entire-circumferentially act between the peripheral surface P1 on the one end side of the plunger 7 and the opposed surface Y1 of the first yoke part 5 and between the peripheral surface P2 on the other end side of the plunger 7 and the opposed surface Y2 of the second yoke part 6. The plunger 7 is attracted in the radial direction by the resultant force of the horizontal component forces F1 of the forces F and attracted, in the axial direction, toward the stator 1 by the vertical component forces F2 thereof. Immediately after the energization, the magnetic flux balance passing through the plunger 7 is biased to the radial one end H1 side, in which the magnetic resistance is lower, so the resultant force of the horizontal component forces F1, which acts on the plunger 7, is increased on the radial one end H1 side. Therefore, the plunger 7 in the guide pipe 4 is attracted toward the radial one end H1 side and slides therein.

Fourth Embodiment

Figure 7:
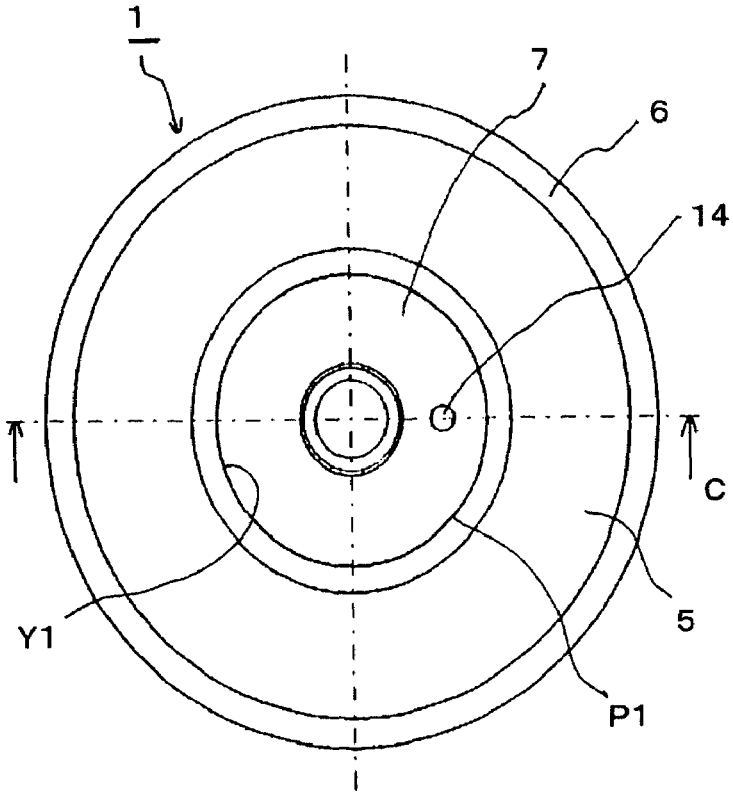
FIG. 7 is a plan view of a linear solenoid of a fourth embodiment.

Next, another linear solenoid will be explained with reference to FIGS. 7 and 8. The structure is similar to that of the first embodiment (see FIG. 1), so the same structural elements are assigned the same symbols and explanation will be omitted. The differences will be mainly explained.

Figure 8:
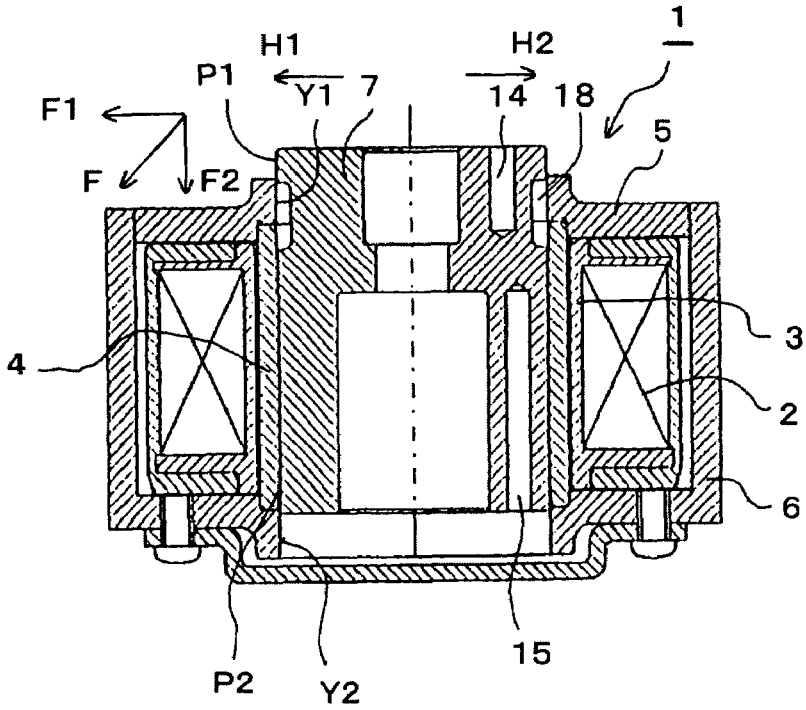
FIG. 8 is a sectional view of the linear solenoid taken along a line C-C shown in FIG. 7.

In FIG. 8, a circular groove or a stepped surface is formed in the peripheral surface of at least one of the end sides of the plunger 7 (the groove 18 is formed in the present embodiment), and the magnetic flux acting surface is formed in the radial direction. In the present embodiment, as shown in FIG. 7, holes 14 and 15 are respectively bored in axial upper and lower end faces of the plunger 7. In FIG. 8, the holes 14 and 15 are bored eccentrically to the radial end H2 side of the plunger 7. By forming the holes 14 and 15, the magnetic flux path passing through the plunger 7 is partially biased by energization. With this structure, the magnetic resistance of the opposed surfaces of the first and second yoke parts 5 and 6 corresponding to the peripheral surface of the plunger 7 is unbalanced in the circumferential direction. Sizes of the holes 14 and 15 and positions thereof, which are defined by positions in the circumferential direction and positions in the radial direction, need not be corresponded. The hole may be bored in at least one of the radial end faces of the plunger 7 and may be a through-hole or a bottomed hole.

In FIG. 8, when the exciting coil 2 is energized, the attraction forces F (the horizontal component forces F1 and the vertical component forces F2) entire-circumferentially act between the peripheral surface P1 on the one end side of the plunger 7 and the opposed surface Y1 of the first yoke part 5 and between the peripheral surface P2 on the other end side of the plunger 7 and the opposed surface Y2 of the second yoke part 6. The plunger 7 is attracted in the radial direction by the resultant force of the horizontal component forces F1 of the forces F and attracted, in the axial direction, toward the stator 1 by the vertical component forces F2 thereof. Immediately after the energization, the magnetic flux balance passing through the plunger 7 is biased to the radial one end H1 side, in which magnetic flux density is high, so the resultant force of the horizontal component forces F1, which acts on the plunger 7, is increased on the radial one end H1 side. Therefore, the plunger 7 in the guide pipe 4 is attracted toward the radial one end H1 side and slides therein.

Fifth Embodiment

Figure 9:
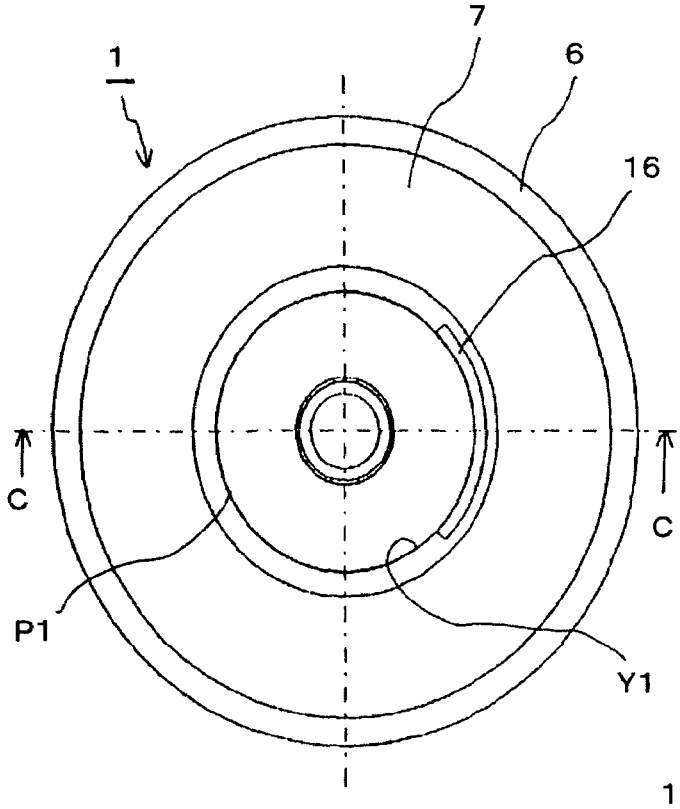
FIG. 9 is a plan view of a linear solenoid of a fifth embodiment.

Next, another linear solenoid will be explained with reference to FIGS. 9 and 10. The structure is similar to that of the first embodiment (see FIG. 1), so the same structural elements are assigned the same symbols and explanation will be omitted. The differences will be mainly explained.

Figure 10:
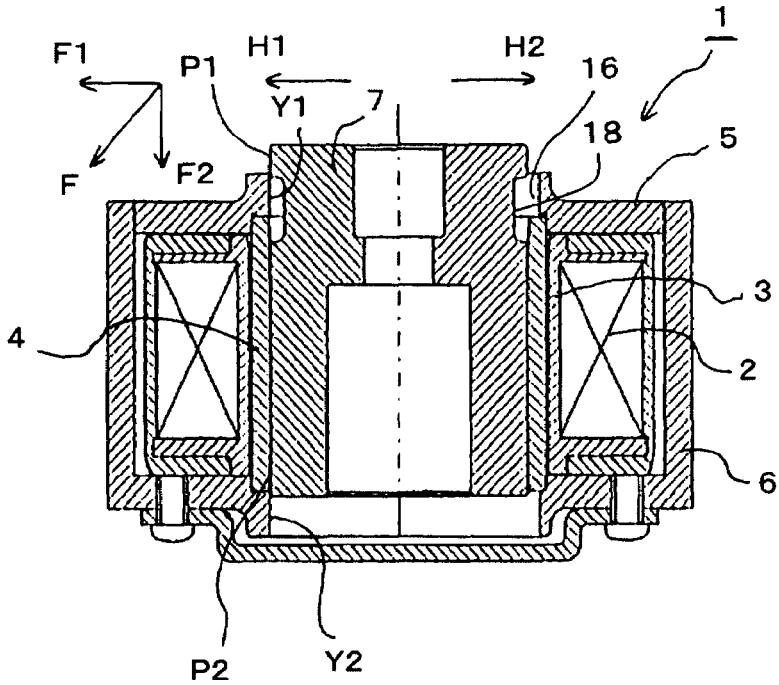
FIG. 10 is a sectional view of the linear solenoid taken along a line. C-C shown in FIG. 9.

In FIG. 10, a circular groove or a stepped surface is formed in the peripheral surface of at least one of the end sides of the plunger 7 (the groove 18 is formed in the present embodiment), and the magnetic flux acting surface is formed in the radial direction. In the present embodiment, as shown in FIG. 9, a notch 16 is formed in the opposed surface Y1 of the first yoke part 5, which faces the peripheral surface of the plunger 7 on which the magnetic flux acting surface is formed. By forming the notch 16, the magnetic resistance of the opposed surfaces of the first and second yoke parts 5 and 6 corresponding to the peripheral surface of the plunger 7 is unbalanced in the circumferential direction. Not that, the notch 16 may be formed in the opposed surface Y2 of the second yoke part 6, and notches may be formed in the both of the opposed surfaces Y1 and Y2 of the first and second yoke parts 5 and 6.

In FIG. 10, when the exciting coil 2 is energized, the attraction forces F (the horizontal component forces F1 and the vertical component forces F2) entire-circumferentially act between the peripheral surface P1 on the one end side of the plunger 7 and the opposed surface Y1 of the first yoke part 5 and between the peripheral surface P2 on the other end side of the plunger 7 and the opposed surface Y2 of the second yoke part 6. The plunger 7 is attracted in the radial direction by the resultant force of the horizontal component forces F1 of the forces F and attracted, in the axial direction, toward the stator 1 by the vertical component forces F2 thereof. Immediately after the energization, the magnetic flux balance passing through the plunger 7 is biased to the radial one end H1 side, in which the magnetic resistance is low, so the resultant force of the horizontal component forces F1, which acts on the plunger 7, is increased on the radial one end H1 side. Therefore, the plunger 7 in the guide pipe 4 is attracted toward the radial one end H1 side and slides therein.

Sixth Embodiment

Figure 11:
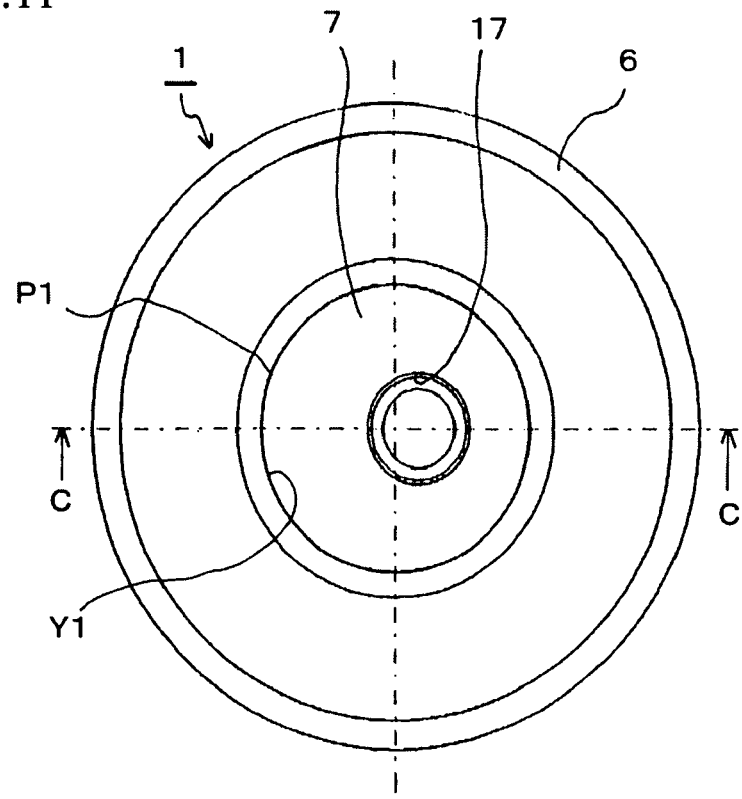
FIG. 11 is a plan view of a linear solenoid of a sixth embodiment.

Next, another linear solenoid will be explained with reference to FIGS. 11 and 12. The structure is similar to that of the first embodiment (see FIG. 1), so the same structural elements are assigned the same symbols and explanation will be omitted. The differences will be mainly explained.

Figure 12:
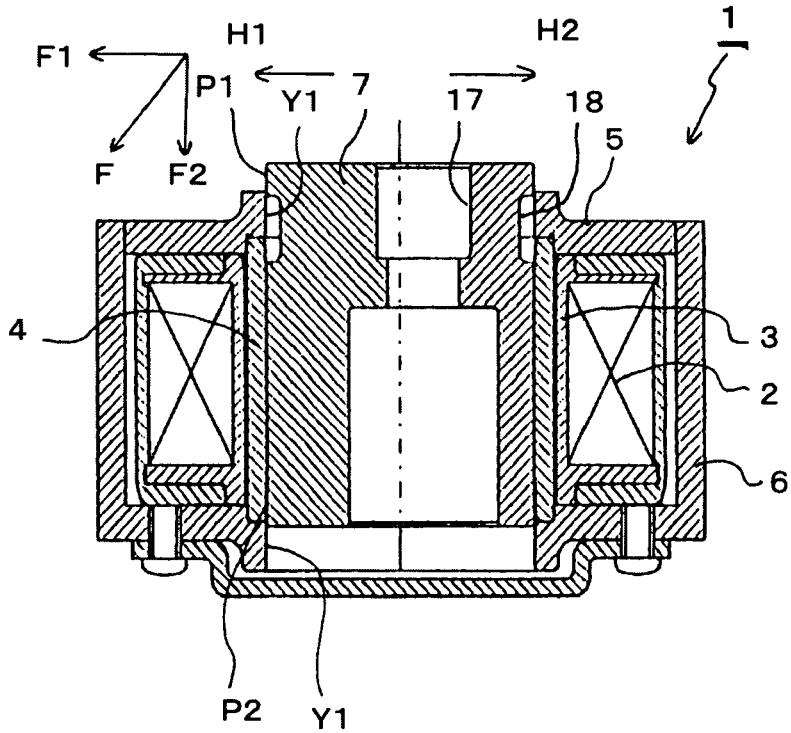
FIG. 12 is a sectional view of the linear solenoid taken along a line C-C shown in FIG. 11.
Figure 13:
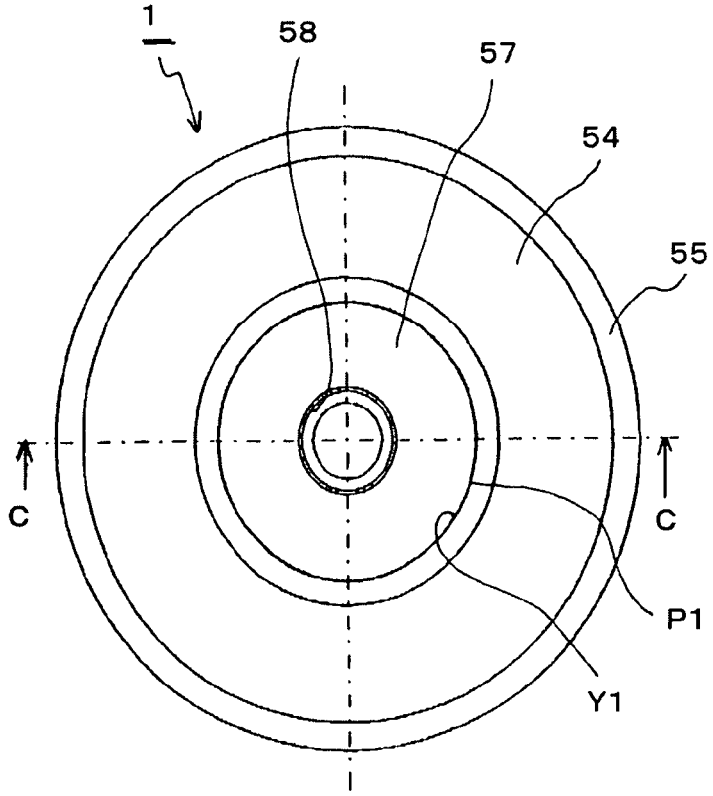
FIG.13 PRIOR ART
FIG. 13 is a plan view of the conventional linear solenoid.
Figure 14:
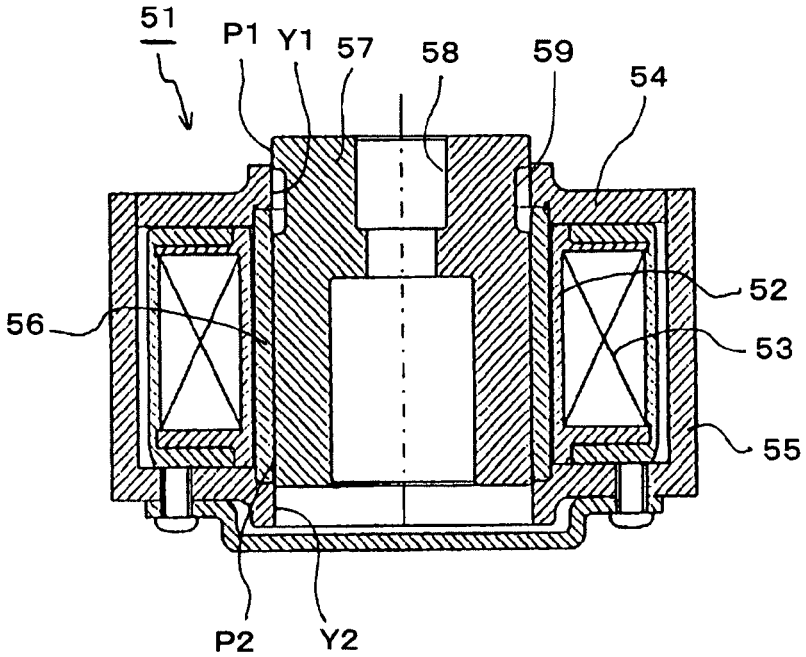
FIG.14 PRIOR ART
FIG. 14 is a sectional view of the conventional linear solenoid taken along a line C-C shown in FIG. 13.
Figure 15:
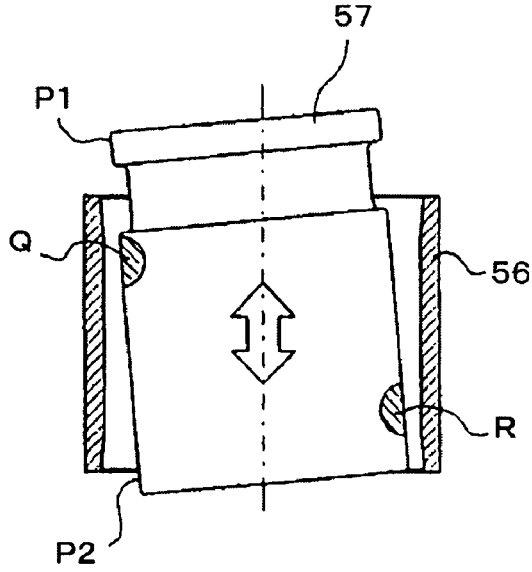
FIG.15 PRIOR ART
FIG. 15 is a partial enlarged view showing the sliding parts of the plunger and the guide pipe relating of the conventional linear solenoid.
Figure 16:
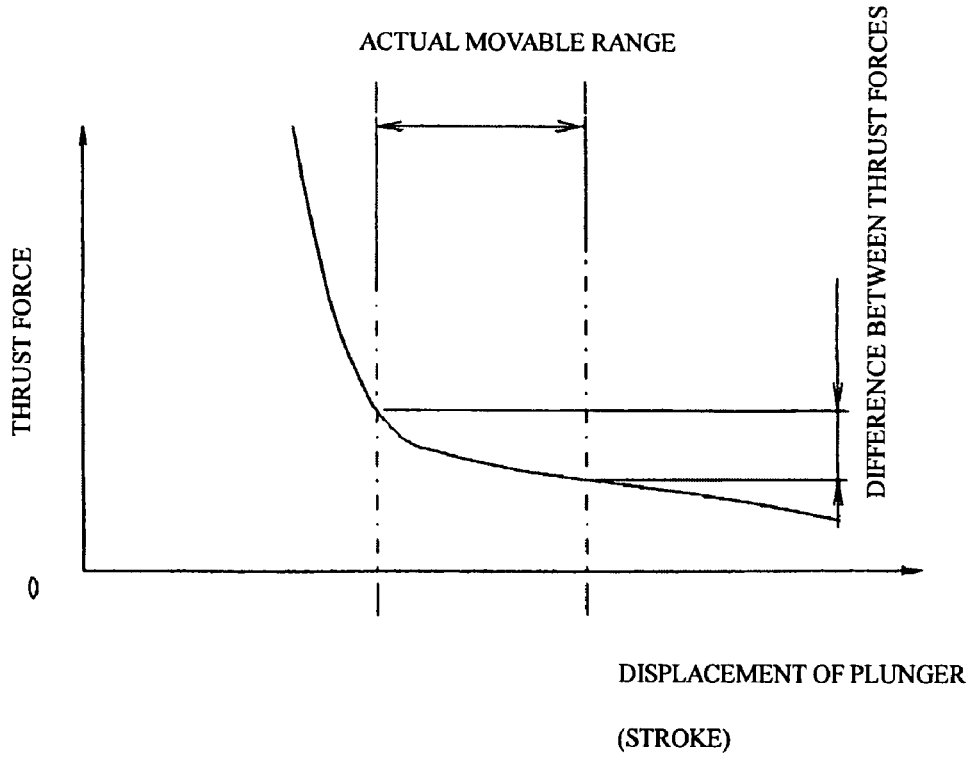
FIG.16 PRIOR ART
FIG. 16 is a graph showing a relationship between displacement of the conventional linear solenoids and thrust forces.

In FIG. 12, a circular groove or a stepped surface is formed in the peripheral surface of at least one of the end sides of the plunger 7 (the groove 18 is formed in the present embodiment), and the magnetic flux acting surface is formed in the radial direction. In the present embodiment, as shown in FIG. 11, an axial hole 17, which is formed for connecting an output shaft, is eccentrically formed in the plunger 7. In FIG. 12, the axial hole 17 is formed eccentrically to the radial end H2 side. By eccentrically forming the axial hole 17, the magnetic flux path passing through the plunger 7 is partially biased by energization. With this structure, the magnetic resistance of the opposed surfaces of the first and second yoke parts 5 and 6 corresponding to the peripheral surface of the plunger 7 is unbalanced in the circumferential direction.

In FIG. 12, when the exciting coil 2 is energized, the attraction forces F (the horizontal component forces F1 and the vertical component forces F2) entire-circumferentially act between the peripheral surface P1 on the one end side of the plunger 7 and the opposed surface Y1 of the first yoke part 5 and between the peripheral surface P2 on the other end side of the plunger 7 and the opposed surface Y2 of the second yoke part 6. The plunger 7 is attracted in the radial direction by the resultant force of the horizontal component forces F1 of the forces F and attracted, in the axial direction, toward the stator 1 by the vertical component forces F2 thereof. Immediately after the energization, the magnetic flux balance passing through the plunger 7 is biased to the radial one end H1 side, in which magnetic flux density is high, so the resultant force of the horizontal component forces F1, which acts on the plunger 7, is increased on the radial one end H1 side. Therefore, the plunger 7 in the guide pipe 4 is attracted toward the radial one end H1 side and slides therein.

Note that, the shapes of the magnetic flux acting surfaces of the plunger 7 and the first and second yoke parts 5 and 6 may be defined by not only combinations of "the groove and the notch", "the notch part and the stepper part" and "the groove and the stepper part" but also combinations of "the groove and the groove", "the notch part and the notch part", "the stepped part and the stepper part", etc. A plurality of tooth-shaped parts (concavities and convexities) may be formed in the plunger 7 and the opposed surfaces of the first and second yoke parts 5 and 6 in the axial direction. Further, the gaps may be formed on the movable element side and/or the first and second yoke parts 5 and 6 side. The linear solenoid may be a pull type or a push type, a permanent magnet may be included in the magnetic circuit, and the linear solenoid may be driven by a DC power source or an AC power source.

What is claimed is:

1. An actuator comprising:

an exciting coil;

a stator having a first yoke part, which is formed on the one end side of said exciting coil, and a second yoke part, which is formed on the other side of said exciting coil, so as to cover said exciting coil; and a movable element being provided in a center part of said exciting coil and capable of reciprocally moving in the axial direction, wherein a magnetic circuit is formed between the first and second yoke parts and said movable element by energization, and a magnetic force acts on said movable element, wherein an inclined groove is formed in the peripheral surface on the one end side of the movable element and continuously inclined from the radial one end side of the movable element to the other end side thereof, a facing area of the peripheral surface of the movable element, on which the magnetic flux acting surface is formed, is gradually reduced in the axial direction, and the movable element in the center part of the exciting coil is attracted, by energizing the exciting coil, toward a guide surface on the radial one end side, in which magnetic resistance is lower, and slides thereon.

2. An actuator comprising:

an exciting coil;

a stator having a first yoke part, which is formed on the one end side of said exciting coil, and a second yoke part, which is formed on the other side of said exciting coil, so as to cover said exciting coil; and a movable element being provided in a center part of said exciting coil and capable of reciprocally moving in the axial direction, wherein a magnetic circuit is formed between the first and second yoke parts and said movable element by energization, and a magnetic force acts on said movable element, wherein a continuous slope surface is formed in at least one of the first and second yoke parts, which faces the magnetic flux acting surface of the movable element, so as to gradually reduce a facing area of the yoke part from the radial one end side of the movable element to the other end side thereof, and the movable element in the center part of the exciting coil is attracted, by energizing the exciting coil, toward a guide surface on the radial one end side, in which magnetic resistance is lower, and slides thereon.

3. An actuator comprising:

an exciting coil;

a stator having a first yoke part, which is formed on the one end side of said exciting coil, and a second yoke part, which is formed on the other side of said exciting coil, so as to cover said exciting coil; and a movable element being provided in a center part of said exciting coil and capable of reciprocally moving in the axial direction, wherein a magnetic circuit is formed between the first and second yoke parts and said movable element by energization, and a magnetic force acts on said movable element, wherein magnetic resistance of the movable element is non-uniformized in the circumferential direction by chamfering the peripheral part of the movable element, on which a magnetic flux acting surface is formed, to have a D-shape in a horizontal cross section, forming a hole eccentrically to the radial one end of the movable element, forming a notch in the peripheral surface of the movable element on which the magnetic flux acting surface is formed, or forming an axial hole in the movable element eccentrically, and the movable element in the center part of the exciting coil is attracted, by energizing the exciting coil, toward a guide surface on the radial one end side, in which magnetic resistance is lower, and slides thereon.

* * * * *